United States Patent [19]

Matzén

[11] 4,040,330

[45] Aug. 9, 1977

[54] METHOD OF CHARGING DRILL HOLES AND MEANS FOR CARRYING OUT THE METHOD

[76] Inventor: Nils Denny Matzén, Damastvagen 6a, S-16148, Bromma, Sweden

[21] Appl. No.: 643,813

[22] Filed: Dec. 23, 1975

[30] Foreign Application Priority Data

Dec. 30, 1974 Sweden ..... 7416357

[51] Int. Cl.[2] ..... F42D 1/08

[52] U.S. Cl. ..... 86/20 C; 102/23

[58] Field of Search ..... 86/20 C; 102/20, 21, 102/21.4, 21.8, 23; 175/1

[56] References Cited

U.S. PATENT DOCUMENTS

| | | | |
|---|---|---|---|
| 2,745,346 | 5/1956 | Aitchison et al. | 102/23 |
| 2,879,149 | 3/1959 | Brown | 102/23 X |
| 2,903,969 | 9/1959 | Kolbe | 86/20 C X |
| 3,064,572 | 11/1962 | Aitchison | 102/23 |
| 3,188,906 | 6/1965 | Beck | 86/20 C |
| 3,199,399 | 8/1965 | Gardner | 86/20 C |
| 3,696,703 | 10/1972 | Fox | 86/20 C |

FOREIGN PATENT DOCUMENTS

| | | | |
|---|---|---|---|
| 703,542 | 2/1965 | Canada | 102/21.8 |
| 817,649 | 7/1969 | Canada | 102/23 |

*Primary Examiner*—David H. Brown

[57] ABSTRACT

A method and device for charging a drill hole with explosives including a stocking of thin flexible material folded up to form a bellows with an axial duct closed at one end, a charging hose inserted into the duct on which the bellows slides, and a protecting sleeve at least partially enclosing the bellows so that upon charging of the hose the bellows is straightened out fold by fold and the bellows glides on the hose out of the drill hole.

In a second embodiment the protecting sleeve slides on the charging hose and the stocking is connected to the lower end of the sleeve, from there folded upon itself to form a bellows extending upwardly around the sleeve and being folded upon itself around the folded up portion and around the lower end of the charging hose and being closed at its lower end so that upon charging of the drill hole through the charging hose the stocking and sleeve slide on the hose out of the drill hole.

4 Claims, 3 Drawing Figures

METHOD OF CHARGING DRILL HOLES AND MEANS FOR CARRYING OUT THE METHOD

The present invention refers to a method of charging drill holes and means for carrying out the method.

Known in the prior art is a method of charging drill holes with pumpable explosives. To this end there is used a cylindrical sleeve containing a stocking, closed at one end, of thin flexible material, folded up like a bellows to a small length and with a duct concentric with the sleeve going through the bellows. In a hole coaxial with the duct the end of a charging hose is attached in one end of the sleeve, and the sleeve with the bellows is introduced with the help of the charging hose into the drill hole right to the bottom of said hole. When the explosive is pumped through the charging hose into the bellows, the latter is unfolded fold by fold and leaves the sleeve at its other open or openable end, the charging hose with the sleeve gliding out of the drill hole as it is filled with the explosive enveloped by the thin-walled stocking.

This apparatus functions well when working with pumpable, i.e. liquid or paste-like explosives, but it cannot be used for charging drill holes with granular or powdery explosives which are introduced into the drill hole pneumatically.

It has indeed been proposed to arrange air bleed ducts so that the conveying air can depart from the bellows and flow out through the space between the drill hole and the charging hose. Such air bleed ducts can, however, be easily clogged up by material which is entrained by the conveying air, and furthermore, water can come into the bellows through the air bleed ducts which the sleeve is introduced into the drill hole and before conveying air is blown in.

It has also been previously proposed to introduce a stocking of thin plastic film folded to form a bellows and provided with a nosepiece which, with the aid of claw-like means is retained in the drill hole at its bottom, whereafter the plastic film stocking is drawn out so that the drill hole is lined with it, whereon the charging hose is introduced into the stocking in the drill hole and charging is carried out in the usual manner. In this case, however, the thin plastic film stocking can be easily torn by the charging hose. The stocking can also be compressed by water which may have come into the drill hole, and which can make it impossible to introduce the charging hose.

According to the present invention, the problem of charging by means of pneumatically conveying an explosive into a thin-walled stocking in a drill hole has been solved without meeting the disadvantages burdening the above-mentioned methods. Thus, according to the invention, is intended the method of charging drill holes defined in the following main claim. In particular, powdery explosive is pneumatically introduced into a stocking of thin flexible material, closed at one end and situated in the drill hole. This thin-walled stocking suitably consists of plastic film, but the material from which it is made is not of deciding importance for the invention. The thin-walled stocking only has to withstand the stresses to which it is exposed, but these are minor, since, as will be explained in greater detail below, excess pressure cannot occur in the stocking, and any relative movement between the wall of the drill hole and the thin-walled stocking not need to take place. For the sake of simplicity, the thin-walled stocking is designated "stocking" hereinafter, and, as pointed out above, it can consist of plastic film or any other suitable material.

The stocking, folded up into a bellows with an axial duct is placed in a sleeve which is open or openable at one end, this then being placed on a charging hose by introducing the end of the charging hose into the bellows duct through a hole in an end wall at the other (or outer) end of the sleeve. With the aid of the charging hose the sleeve is subsequently introduced into a drill hole right down to the bottom of the hole. Instead of now unfolding the bellows with the help of the explosive introduced through the charging hose, the bellows is, according to the present invention, straightened out by means of compressed air being blown in through the charging hose while its end is kept at the remote end of the stocking at the bottom of the drill hole. The bellows is thereby folded out successively fold by fold from the bottom of the drill hole and outward, the stocking successively leaving the sleeve, which moves outwardly and thereby glides on the charging hose. The hole in the sleeve through which the charging hose is introduced into the duct of the bellows can be somewhat larger than the cross-section of the charging hose, so that the compressed air can depart via a gap between the sleeve and the charging hose. The hole should naturally be as small as possible, although not smaller than to allow for introduction of the charging hose, so that for example, water coming into the drill hole is prevented from coming into the bellows. On the other hand, the hole must be large enough to allow the sleeve to slide smoothly on the charging hose. A suitable, e.g. an inwardly directed collar can be arranged around the hole for guiding the sleeve when it glides on the charging hose. On the other hand, the axial duct in the bellows which, due to its construction, is elastically yielding, can have an inside diameter which is somewhat less than the outside diameter of the charging hose so that the end of the charging hose is retained in the duct. Only a very small amount of water can thus find its way into the bellows while the sleeve is being introduced into the drill hole, since the outer end of the charging hose is closed and the air cannot be displaced by the water. As soon as the sleeve with the fold-up stocking has been taken to the bottom of the drill hole, compressed air is introduced into the hose and water which has possibly seeped in is forced back, the stocking subsequent thereto being unfolded in the manner described above.

When the sleeve reaches the drill hole opening it can be removed, and the stocking fastened in a suitable way. The sleeve can possibly be retained and used as an attachment for the stocking or as a dust guard.

Pneumatic charging can now be carried out in the usual way and the charging hose withdrawn successively, as the drill hole is filled with explosive. Alternatively, pneumatic charging can already be started with the stocking folded up, the conveying air thus straightening out the stocking.

After having straightened out the stocking as described above, it is naturally possible to introduce therein pumpable, i.e. liquid or paste-like explosive.

Since the sleeve protects the stocking while it is being folded out in the drill hole, and since the straightened-out stocking does not move in relation to the drill hole wall, but only in relation to the smooth inner wall of the sleeve, the stocking is not exposed to any risk of being torn against unevennesses in the drill hole wall.

If the air pressure in the stocking becomes very high while the bellows is being unfolded, air can depart through the gap between the charging hose and the sleeve.

Since the charging hose is kept still in the stocking with its end at the closed end of the stocking the whole time, until the charging operation is started, and air is blown in through the charging hose, there is no risk that water in the drill hole presses the stocking together to make charging impossible. After the stocking has been filled with explosive, water can no longer press into the drill hole, because the stocking has a somewhat larger outer diameter than the sleeve which causes the stocking, when it comes out of the sleeve to be pressed into tight engagement with the wall of the drill hole. Water which was possibly in the drill hole when the sleeve was introduced therein, is successively forced away when the sleeve, gliding on the charging hose, is moved out of the drill hole and the stocking leaving the sleeve closes against the wall of the drill hole to lie sealingly against it.

It is naturally an advantage for the stocking to be folded out by the sleeve gliding on the charging hose, and not as previously proposed when using the folded-up stocking described by way of introduction, to have it fixed on the end of the charging hose, since in the method according to the invention there is therefore no risk that air bleeding is made impossible by some air bleed duct being clogged up. Since the charging hose in the previously known method is fixed in the sleeve which contains the folded-up stocking, the latter can, when pneumatic conveying is used, be folded out without being filled with explosive, if the air bleed ducts do not function satisfactorily. If this happens, the stocking is straightened out and the charging hose is thrown out of the drill hole, and it will be very difficult to reintroduce the charging hose into the stocking in the drill hole, because the charging hose could, for example, tear the stocking.

Alternatively, also according to the present invention the stocking can be folded out with the help of a pumpable explosive, whereby the pumped-in explosive straightens out the stocking. In this case especially, the sleeve is provided with fracture impressions. For example, the sleeve is divided into sections of 7 cm by means of transverse fracture impressions. When the stocking is filled with pumpable explosive, the first folds are straightened out and leave the sleeve, but when the frictional interface between the filled stocking and the sleeve is too great, the stocking can stick and have difficulty in leaving the sleeve. When the force has become sufficiently great, the innermost fracture impression breaks and the innermost section leaves the sleeve, whereafter the described cycle is repeated. If the fracture impressions are made coaxially with the sleeve, they break, for the reasons given above, from the interior and outwardly so that the sleeve widens and releases the stocking.

It is naturally possible to combine charges of different kinds, for example to begin with pneumatic charging, and thereby straightening out the stocking, subsequently introducing a plug of pumpable explosive and possibly, if so desired, continuing with pneumatic charging etc., or beginning by charging pumpable explosive and continuing with pneumatic charging etc.

The sleeve according to the present invention is, as pointed out above, open or openable at the interior or remote end, in relation to the end from which the charging hose is introduced. The sleeve can thus, for example, be completely open and possibly somewhat crimped at the end or also be provided with a cap, e.g. of the same material from which it is produced, such as thin plastic material, pasteboard or the like. When compressed air is introduced through the charging hose, the end of which is introduced in the central duct through the bellows formed by the folded-up stocking, with the opening in the vicinity of the closed end of the stocking, the folded-up stocking begins to straighten out, whereby the sleeve glides on the hose outwardly from the drill hole, and the removable cap, which possibly originally sat on the sleeve, remains at the bottom of the drill hole. If there is no cap, the closed end of the stocking will naturally lie directly against the bottom of the drill hole or against the primer there.

The invention will now be described in detail, while referring to the embodiments chosen as examples and illustrated on the attached drawings. The invention in naturally not limited to these, but includes everything within the scope of the following claims.

Figure 1:
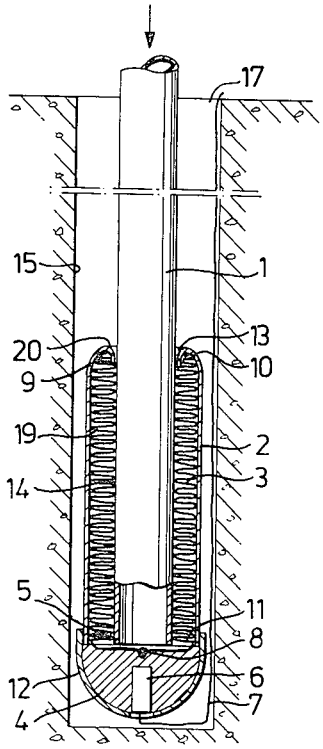
FIG. 1 is a longitudinal section through a drill hole with the charging device according to the present invention shown in the position the device occupies prior to actual charging.

In FIG. 1 is shown how the charging hose 1 is introduced into the duct 14 through the bellows 19 of a folded stocking 3 with an open end 9, in the sleeve 2. The end 5 of the charging hose 1 is taken right down to the closed end 8 of the stocking 3, under which the primer 4 with the detonator 6 and the detonator wire 7 is arranged in the cap 12 of the sleeve 2. The upper end 10 of the sleeve is provided with a hole 13 which has a somewhat larger diameter than the outside diameter of the charging hose 1 while the lower end 11 of sleeve 2 is open. At the upper end 10 of the sleeve there is suitably arranged a guiding collar 20.

Figure 2:
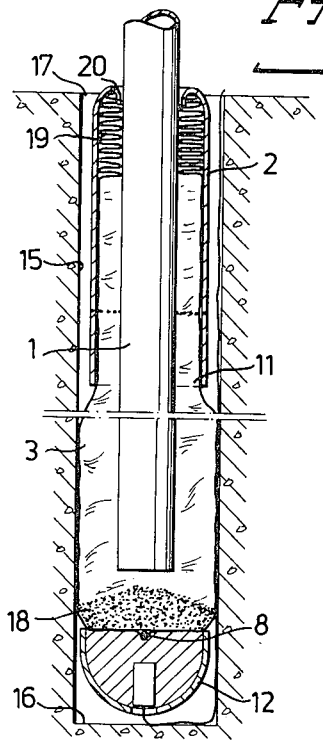
FIG. 2 shows the device of FIG. 1 during charging.

In FIG. 2 is shown how the sleeve 2 has been released from the cap 12 and has moved upwards while the folded-up stocking 3 has been straightened out and lies against the wall of the drill hole 15. The sleeve 2 continues upwards to the upper end 17 of the drill hole 15, while the stocking 3 is successively folded out. Thereafter powdery explosive 18 is blown in through the charging hose 1, as indicated in the FIGURE.

Since air can freely depart from the device according to the invention, it can be made very simply, and it is not necessary, for example as has been previously proposed, to have double sleeves and arrange the bellows of folded-up stocking in the annular space between the sleeves. If so desired, such double sleeves can naturally be arranged but is is above all not necessary to arrange further coaxial sleeves to achieve an annular duct for leading away the compressed air. The inner sleeve which possibly may be used can constitute a continuation of the above-mentioned guiding collar.

Figure 3:
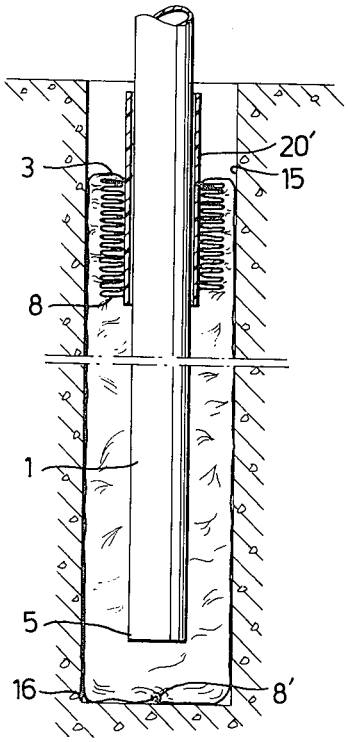
FIG. 3 is a longitudinal section through a drill hole with a modified charging device according to the present invention.

In FIG. 3 there is shown a modified embodiment of the invention. The stocking 3, folded up into a bellows, is placed on a sleeve 20' which can be regarded as an extension of the guiding collar 20 in FIGS. 1 and 2.

Instead of one interiorly directed end 8 of the stocking being closed and retained at the bottom of the drill hole 16 this end is fastened round the inner end of the sleeve 20' and the other, outer, end of the stocking is pulled over the folded-up portion or bellows of the stocking and drawn out over its said interior end 8 whereafter it is closed off at 8′ . The charging hose 1 is subsequently introduced through the sleeve 20′ so that its end 5 is kept just adjacent the inner closed-off end 8′ of the stocking 3, and the array is introduced into the drill hole 15 right down to its bottom 16.

When particulate explosive is charged pneumatically through the charging hose 1, the sleeve 20′ glides on the hose out of the drill hole while the stocking 3 is straightened fold by fold from the outer end of the bellows.

The advantage with this modified embodiment of the invention is that the stocking, so to say, protects itself. The stocking turns inside out and engages the wall of the drill hole with its inside while the folded bellows portion glides in the stocking outwardly through the drill hole. To protect the bellows of folded-up stocking when, attached to the end of the charging hose, it is introduced into the drill hole, it can be enclosed in a bag of suitable material, e.g. plastic film. The bag which is introduced until its bottom is against the bottom of the drill hole remains at the bottom of the drill hole when the sleeve with the bellows glides along the charging hose out from the drill hole.

The charging hose 1 is retained at the drill hole bottom 16 and is moved outwardly pro rata to the stocking lined drill hole being filled with the powdery explosive.

If, on the other hand, charging is done with pumpable explosive, the sleeve 20′ is attached to the end 5 of the charging hose 1 and the charging hose is drawn successively outwardly pro rata to the stocking lined drill hole being filled with pumpable explosive. There is then no relative movement between the charging hose 1 and the sleeve 20′ and the bellows of folded stocking is straightened out fold by fold when the bellows is drawn outwardly by the charging hose.

What is claimed is :

1. A device for charging a drill hole with explosives, comprising: a charging hose for insertion into said drill hole, a sleeve slidably received on said hose and having a first and second open end, respectively, more remote and closer to the outside of said drill hole, and a stocking of thin flexible material connected to said sleeve adjacent said first end, said stocking having a first portion folded up to form a bellows extending from said first end towards said second end, and having a second portion connected to said first portion and folded outwardly around said bellows and beyond said bellows in a direction away from second end, and also having a third portion connected to said second portion and closing said stocking, whereby upon charging of said drill hole through said charging hose and stocking unfolds from said first portion and said stocking and said sleeve slide on said charging hose out of the drill hole.

2. A method of charging a drill hole with explosives, comprising the steps of: folding a thin-walled stocking of flexible material into a bellows with an axial duct, placing said stocking in a sleeve having an open end, placing said sleeve on the end of a charging hose by introducing the same into said axial duct introducing the sleeve and charging hose into the drill hole, introducing powdery explosives pneumatically into the thin-walled stocking while the end of the charging hose is restrained in the drill hole, whereby the bellows is successively straightened out fold by fold from the interior of the drill hole outwardly and the sleeve slides on the charging hose outwardly of the drill hole, and successively withdrawing said charging hose from said drill hole as said stocking is filled with explosives.

3. A method according to claim 2, wherein compressed air is blown into said duct prior to introducing pneumatically powdery explosives into said stocking.

4. A method of charging a drill hole with explosives, comprising the steps of: preparing a sleeve open at both ends, preparing a thin-walled stocking of flexible material open at both ends, connecting one end of said stocking to one end of said sleeve and folding said stocking into a bellows around said sleeve from said one end towards said other end, folding said stocking over said bellows, closing said other end of said stocking after it has been drawn over said bellows and said other end of the sleeve, introducing a charging hose into the sleeve, introducing said charging hose, sleeve and stocking into said drill hole, and introducing explosives through said charging hose while the thin-walled stocking straightens out fold by fold from said bellows.

* * * * *

UNITED STATES PATENT AND TRADEMARK OFFICE

CERTIFICATE OF CORRECTION

PATENT NO. : 4,040,330

DATED : August 9, 1977

INVENTOR(S) : NILS DENNY MATZEN

It is certified that error appears in the above-identified patent and that said Letters Patent are hereby corrected as shown below:

Column 6, line 7, change "and" to -- said --.

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*